US006354260B1

(12) United States Patent
Newsom et al.

(10) Patent No.: US 6,354,260 B1
(45) Date of Patent: Mar. 12, 2002

(54) REPLACEABLE COMBUSTION CHAMBER INSERT FOR TWO CYCLE ENGINES AND METHOD FOR MANUFACTURING SAME

(75) Inventors: Curtis W. Newsom, Tulsa; Alfred O. Bernard, Mannford, both of OK (US)

(73) Assignee: CWN, Inc., Tulsa, OK (US)

( * ) Notice: Subject to any disclaimer, the term of this patent is extended or adjusted under 35 U.S.C. 154(b) by 0 days.

(21) Appl. No.: 09/712,602

(22) Filed: Nov. 14, 2000

(51) Int. Cl.[7] ..... F02B 75/08
(52) U.S. Cl. ..... 123/193.5
(58) Field of Search ..... 123/193.3, 193.5

(56) References Cited

U.S. PATENT DOCUMENTS

| | | | | |
|---|---|---|---|---|
| 1,260,859 A | | 3/1918 | Bie | |
| 1,914,940 A | | 6/1933 | Chilton | |
| 4,112,906 A | * | 9/1978 | Spencer | 123/193.5 |
| 4,519,359 A | | 5/1985 | Dworak et al. | 123/668 |
| 4,530,341 A | | 7/1985 | Palm | 123/669 |
| 4,532,896 A | | 8/1985 | Nakahara et al. | |
| 4,552,108 A | * | 11/1985 | Schausberger | 123/193.5 |
| 4,562,798 A | | 1/1986 | Van Os | |
| 4,630,345 A | | 12/1986 | Lutz | |
| 4,646,692 A | | 3/1987 | Deuber et al. | |
| 5,211,153 A | | 5/1993 | Yonekawa et al. | 123/668 |
| 5,361,730 A | | 11/1994 | Clark et al. | 123/41.81 |
| 5,586,522 A | * | 12/1996 | Phillis et al. | 123/193.5 |
| 5,657,729 A | | 8/1997 | Atmur et al. | 123/193.5 |

* cited by examiner

*Primary Examiner*—Marguerite McMahon
(74) *Attorney, Agent, or Firm*—Head, Johnson & Kachigian

(57) ABSTRACT

An improved replaceable combustion chamber insert for two cycle engines produced by determining, positioning and measuring internal and external cylinder head dimensions of water passages, water connection, and bolt hole patterns within which said insert is to be positioned and machining said insert inner diameters, o-ring groove, dome, and outer shape to correspondingly complement said determined location and measurement dimensions and said cylinder head's bore diameter causing said insert to extend between 5 to 8 thousandths of inch below the bottommost surface of said cylinder head so as to create a compressible surface; and accommodating a spark plug aperture within said insert.

2 Claims, 2 Drawing Sheets

REPLACEABLE COMBUSTION CHAMBER INSERT FOR TWO CYCLE ENGINES AND METHOD FOR MANUFACTURING SAME

REFERENCE TO PENDING APPLICATIONS

This application is not related to any pending applications.

REFERENCE TO MICROFICHE APPENDIX

This application is not referenced in any microfiche appendix.

TECHNICAL FIELD OF THE INVENTION

The invention relates generally to internal combustion engines and more specifically to a replaceable combustion chamber insert for two cycle internal combustion engines.

BACKGROUND OF THE INVENTION

Improvements to enhance the performance and combustion efficiency of internal combustion engines are well represented in the prior art. For example:

U.S. Pat. No. 1,260,859 issued on Mar. 26, 1918 to A. Bie discloses a cylinder construction for internal combustion engines, and is concerned particularly with the heads thereof, being designed more especially, though not necessarily exclusively, for constant pressure oil engines having their fuel injection valves arranged centrally in the heads.

U.S. Pat. No. 1,914,940 issued on Jun. 20, 1933 to R. Chilton discloses an improvement in cooling internal combustion engine cylinders and associated parts.

U.S. Pat. No. 4,519,359 issued on May 28, 1985 to Ulf Dworak et al and subsequently assigned to Feldmuhle Aktiengesellschaft discloses a mullite plate. In a cylinder head of a piston engine, the surface of the cylinder head facing the combustion chamber is covered by a plate having openings for valves, spark plugs or injection nozzles. The plate consists of mullite containing 2 to 30% of volume of zirconium oxide and/or hafnium oxide embedded therein, plus 0 to 3 mole-percent of oxides of magnesium, calcium or yttrium, with respect to the zirconium and/or hafnium oxide, and of no more than 0.5%, by weight, of other oxidic impurities.

U.S. Pat. No. 4,530,341 issued on Jul. 23, 1985 to Bengt N. J. Palm and subsequently assigned to Saab-Scania Aktiebolag discloses a piston engine having at least one heat-insulated combustion chamber, and parts for said engine. Improved heat insulating of a combustion chamber in an internal combustion engine is a heat-resistant body in at least one surface, which is intended to at least partly limit a combustion chamber. A support body supports the heat-resistant body, said bodies each having facing mantle surfaces. Between said bodies there is a heat-insulating element of a material having a lower coefficient of thermal expansion and a lower modulus of elasticity than the material in either one of said bodies. The bodies and the element are held together at the mantle surfaces by means of a shrink fit.

U.S. Pat. No. 4,562,798 issued on Jan. 7, 1986 to Cornelis J. Van Os and subsequently assigned to Noord-Nederlandsche Machinefabriek B.V. discloses a cylinder head locking construction for cylinders formed or placed in a casing of a motor, in which high working pressures occur. A segmented ring is partially placed in an annular groove formed in the casing of the motor transversely to the axis of the cylinder head. In operation a portion of the ring projecting from the groove rests on an adjacent portion of the cylinder head. A clamping ring is secured around a raised central portion of the cylinder head and presses the segments in the direction of the cylinder head portion, and at the same time prevents radially inward movement of the segments. The segments are pushed inwardly into contact with the clamping ring by a thrust member such as an O-ring.

U.S. Pat. No. 4,630,345 issued on Dec. 23, 1986 to Dieter Lutz and subsequently assigned to SACHS-Systemtechnik GmbH discloses a cylinder unit of a cylinder-piston-combustion engine comprising a cylinder housing and a lining unit inserted into the cylinder housing. The lining unit consists of a cylindrical liner sleeve and a terminal wall and encloses a combustion space. The terminal wall is integral with the liner sleeve. The lining unit is manufactured by a non-cutting manufacturing method like cold impact forming, hot impact forming, deep drawing, tube reshaping, press molding or injection molding.

U.S. Pat. No. 4,646,692 issued on Mar. 3, 1987 to Andreas Deuber et al and subsequently assigned to Alcan Aluminiumwerk Nurnberg GmbH discloses a component for internal combustion engines and a process for its production. The invention concerns components for internal combustion engines with heat resistant combustion chamber inserts, especially components made of light metal with casted porous ceramic inserts positioned by casting around the basic material, in which in order to lower the gas pressure which builds up under the inserts, at least one gas pressure release bore hole is provided in the basic material of the component which leads to the bottom of said insert. The invention further describes a process for the production of these components in which the insert is first fixed in its position relative to the basic element and thereafter the bore holes are produced in the basic material.

U.S. Pat. No. 5,211,153 issued on May 18, 1993 to Minoru Yonekawa et al and subsequently assigned Kloritz Corporation discloses a two-cycle internal combustion gasoline engine cylinder. The two-cycle engine cylinder according to this invention is characterized in that a smooth hard chromium plated layer is formed on a combustion chamber top inner surface of the cylinder.

U.S. Pat. No. 5,361,730 issued on Nov. 8, 1994 to Richard J. Clark et al and subsequently assigned to Clark Industries, Inc. discloses a unitary cylinder head and liner combination is vertically cast as a one piece unit. The liner incorporates a water jacket therein. The water jacket is draftless, allowing water to circulate therethrough more efficiently, increasing cooling capabilities. Such vertical one piece casting is made possible by a novel two piece core which eliminates the need for welding of metal bands onto an outer surface of the liner to produce the water jacket thereof. A novel method of vertical casting is also provided which allows the cylinder head to be cast internal with the liner, allows for increased water capacity in the liner and integral head passages, and allows for a plurality of enlarged air intake channels to be provided.

U.S. Pat. No. 5,586,522 issued on Dec. 24, 1996 to Lawrence R. Phillis et al discloses a cylinder head for an internal combustion engine which includes a replaceable combustion chamber dome and an engine cylinder head housing which receives and supports the combustion chamber dome therein. The dome includes a spark plug housing that fits within an aperture within the engine cylinder head housing in such a way that rotational movement of the dome relative to the housing is prevented. The engine cylinder head housing includes a fluid coolant inlet port, a dome cooling chamber in fluid communication with the inlet port and which surrounds an outer periphery of the dome, and an exhaust port in fluid communication with the dome cooling chamber whereby coolant is directed to a cylinder block for the engine. The housing further includes a cylinder head housing cooling chamber in fluid communication with coolant within the cylinder block, and an outlet port in fluid communication with the cylinder head housing cooling chamber.

As can be clearly distinguished from the instant invention the '522 patent cannot be practiced absent specifically tooled surfaces which allow for a complimenting locking mechanism to prevent rotational movement of the '522's replaceable dome (See column 2, lines 30–44).

U.S. Pat. No. 5,657,729 issued on Aug. 19, 1997 to Steven Atmur et al and subsequently assigned to Northrop Grumman Corporation discloses a ceramic cylinder head or cylinder head liner for an internal combustion engine. The cylinder head is made of a fiber reinforced ceramic matrix composite material and includes a heat sink on the top surface to keep touch temperatures at a reasonable level. The preferred embodiment employs water cooling so as to reduce engine compartment temperatures and provide a supply of hot water for passenger compartment heating.

This invention relates generally to internal combustion engines of the two cycle design. More specifically, the present invention relates to a tunable replaceable combustion chamber insert supported within a fluid-cooled housing.

Two cycle internal combustion engines are characterized by one or more cylinders consisting essentially of cylindrical bores within an engine or cylinder block. A piston fits within the cylinder such that it can move reciprocally. One end of the cylinder is closed by a cylinder head to establish a combustion chamber between the top of the piston and the cylinder head. The two cycle cylinder construction differs from four-cycle cylinder construction in that the latter incorporates intake and exhaust valves in the cylinder head while the two cycle engine has intake and exhaust ports in the wall of the cylinder.

When the piston is reciprocated to its lowest position in the cylinder, the maximum volume of the cylinder is defined. The minimum cylinder volume is defined when the piston is at its highest position in the cylinder. The ratio of maximum volume to minimum volume is referred to as compression ratio. The greater the compression ratio, the more efficient the engine. In most internal combustion engines, the cylinder head is manufactured with a shaped pocket or chamber which defines the cylinder volume at the highest piston position and therefore directly affects the performance of the engine.

While combustion chamber definition is the single most important function of the cylinder head, the cylinder head also serves to dissipate heat generated by the combustion process. For this reason, water-cooled cylinder heads are generally manufactured in two sections by machining or the like.

There are many applications which require changes in cylinder head design. Such changes may be necessitated not only by a need to vary engine compression ratio but also to adapt an engine for different octane rated fuels or for different fuels. In particular, it is common practice to modify cylinder heads in order to develop high performance engines. In some situations, such as racing, it is often desirable to be able to modify a cylinder head to obtain a performance characteristic suitable for immediate conditions.

Aftermarket cylinder heads are typically manufactured with either integrated combustion chambers as part of the cylinder head itself, or with replaceable combustion chambers. In the case of cylinder heads utilizing replaceable combustion chambers, several problems presently exist. In particular, such combustion chambers do not typically provide adequate cooling to both the cylinder head housing and the replaceable combustion chamber, are not easily modified for changes in different fuels or octane ratings and changes in weather conditions, and they often rotate during spark plug installation and/or removal.

By way of illustration, if during a touring trip a spark plug requires replacement and during that operation it is discovered that the replaceable combustion chamber insert turns without the spark plug being removed, the engine is unable to be operated further. It must be taken to a location where the cylinder head may be removed. The problem is exacerbated during a racing event where the spark plugs must be removed and replaced several times. If such rotation of the combustion chamber insert occurs, the cylinder head must be removed, which could limit a racer's ability to arrive at the starting line on time. While this problem has been described by the prior art in U.S. Pat. No. 5,586,522, the '522 patent's "dome" requires an interlocking means to secure said dome within a uniquely calibrated and interlocking cylinder head can be very costly and complicated to manufacture.

With regard to the problem of adequately cooling the cylinder head and, particularly, the replaceable combustion chamber, typical cylinder head cooling/flow design does not allow for the distinct flow of coolant therethrough in a plurality of flow paths at different temperatures. Thus, the different cooling requirements of the cylinder head in contrast with that of the replaceable combustion chambers are not specifically addressed.

Accordingly, there has been a need for an improved cylinder head for an internal combustion two cycle engine wherein the replaceable combustion chamber can be easily changed according to atmospheric conditions and different fuel or octane ratings for high performance racing and wherein the replaceable combustion chamber insert can be easily and economically machined to prevent rotation during installation/removal of the spark plug. Additionally, there exists a need for a novel replaceable combustion chamber design in which the cross section is uniform in thickness to promote the optimum heat transfer from the effect of the coolant. The present invention fulfills these needs and provides other related advantages.

BRIEF SUMMARY OF THE INVENTION

This invention involves a new method of securing a combustion chamber insert into a water-cooled cylinder head without rotating the insert during installation or removal of the spark plug. The combustion chamber of the instant invention is also tunable for optimum performance in various atmospheric conditions and differing fuel octane ratings. The invention can be practiced on any water-cooled two cycle internal combustion engine, such as a motorcycle, snow mobile, go kart, and other forms of two cycle internal combustion engines and is machined from a single aluminum billet inserted into a cylinder head cover that is water-cooled. The combustion chamber insert may have different combustion chamber volumes for fuel octane rating and atmospheric conditions.

Consequently an objective of the instant invention is to provide a replaceable combustion chamber insert supported within a fluid-cooled housing.

Another objective of the instant invention is to provide an insert allowing for the varying of engine compression ratios.

Yet another objective of the instant invention is to adapt an engine for different octane rated fuels or for different fuels.

A further objective of the instant invention is to modify a cylinder head to obtain a performance characteristic suitable for immediate conditions.

It is an objective of the instant invention to provide for adequate cooling to both the cylinder head housing and the replaceable combustion chamber.

Another objective of the instant invention is to provide an insert which avoids the rotation problems during spark plug installation and/or removal of inserts and cylinder heads associated with the present art.

Yet another object of the instant invention is to allow for the distinct flow of coolant through a replaceable combustion chamber in a plurality of flow paths at their different temperatures.

A further objective of the instant invention is to provide for a novel replaceable combustion chamber design in which the cross-section is uniform in thickness to promote optimum heat transfer precipitated by an engine coolant.

DETAILED DESCRIPTION OF THE PREFERRED EMBODIMENT

While the making and using of various embodiments of the present invention are discussed in detail below, it should be appreciated that the present invention provides for inventive concepts capable of being embodied in a variety of specific contexts. The specific embodiments discussed herein are merely illustrative of specific manners in which to make and use the invention and are not to be interpreted as limiting the scope of the instant invention.

Figure 1:
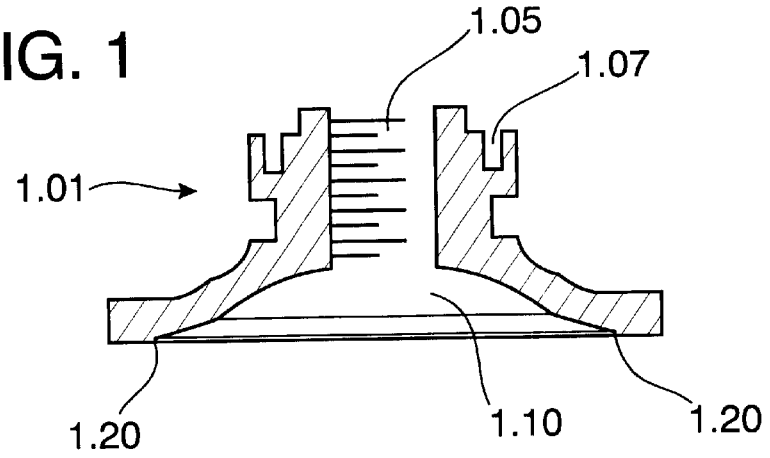
FIG. 1 is a cross-sectional view of the insert of the instant invention.

FIG. 1 is a cross-sectional view of the instant invention. Turning now to FIG. 1.

The combustion chamber insert of the instant invention 1.01 includes a centrally located threaded hole 1.05 for the spark plug around which is machined an o-ring groove 1.07 for an o-ring seal against the cylinder head cover to contain the cooling water. The shape of the combustion chamber includes a stepped dome 1.10 of a diameter that follows the shape of the piston crown of the engine for which it is being designed allowing for a 1–2 mm squish between the top of the piston and the bottom of the insert before starting the radius of the combustion chamber. The unique shape of the stepped dome 1.10 of the combustion chamber allows for the proper swirl and compression of the fresh fuel charge introduced into the combustion chamber for the most efficient ignition and burning for complete combustion of the fuel charge. The outside shape of the insert closely follows the inside shape of a cylinder head to allow for equal heat transfer to the cooling medium.

Figure 2:
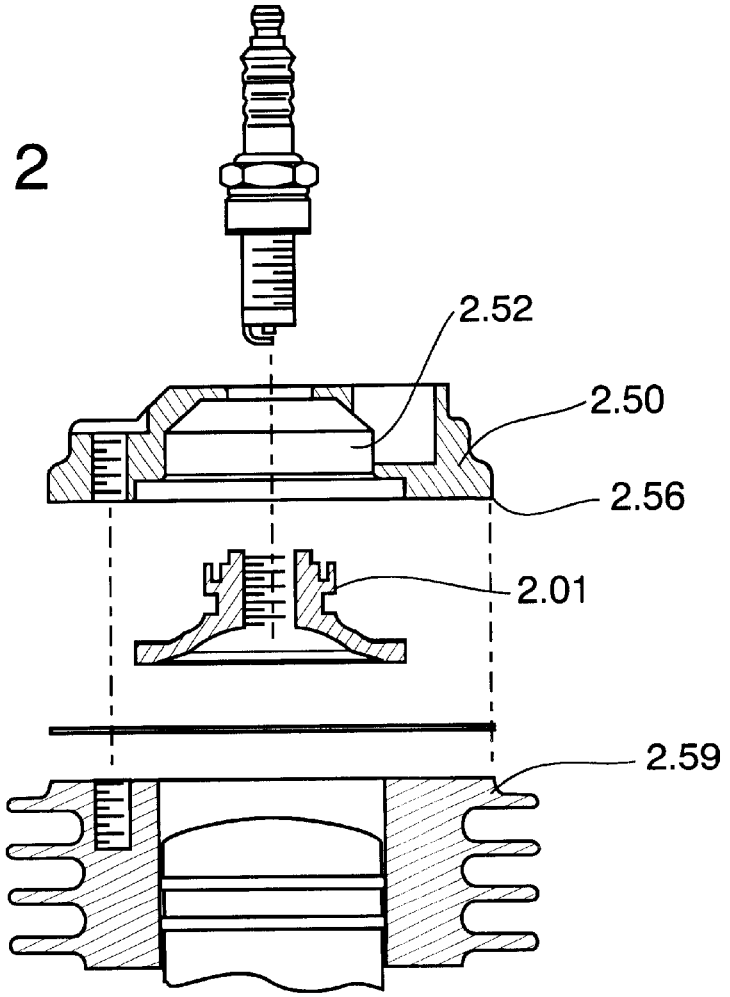
FIG. 2 is a cross-sectional view of the instant invention when practiced in its preferred embodiment and inserted within a two cycle internal combustion engine cylinder head.

As seen in FIG. 2, a cylinder head cover 2.50, having a central bore with steps 2.52 to receive the combustion chamber insert, also contains passages for the cooling medium. The outside diameter and cylinder stud bolt holes are designed to match those of the engine for which it is designed. The mating surface of the cover 2.56 to the cylinder 2.59 contains a recessed centrally located bore to receive the insert with the depth of this bore in relation to the thickness of the insert providing the required "crush" height of 5 to eight thousandths of an inch 1.20 interference to prevent rotation of the insert during spark plug installation and removal when the cylinder head assembly including the insert is properly torqued to the cylinder head studs.

Figure 3:
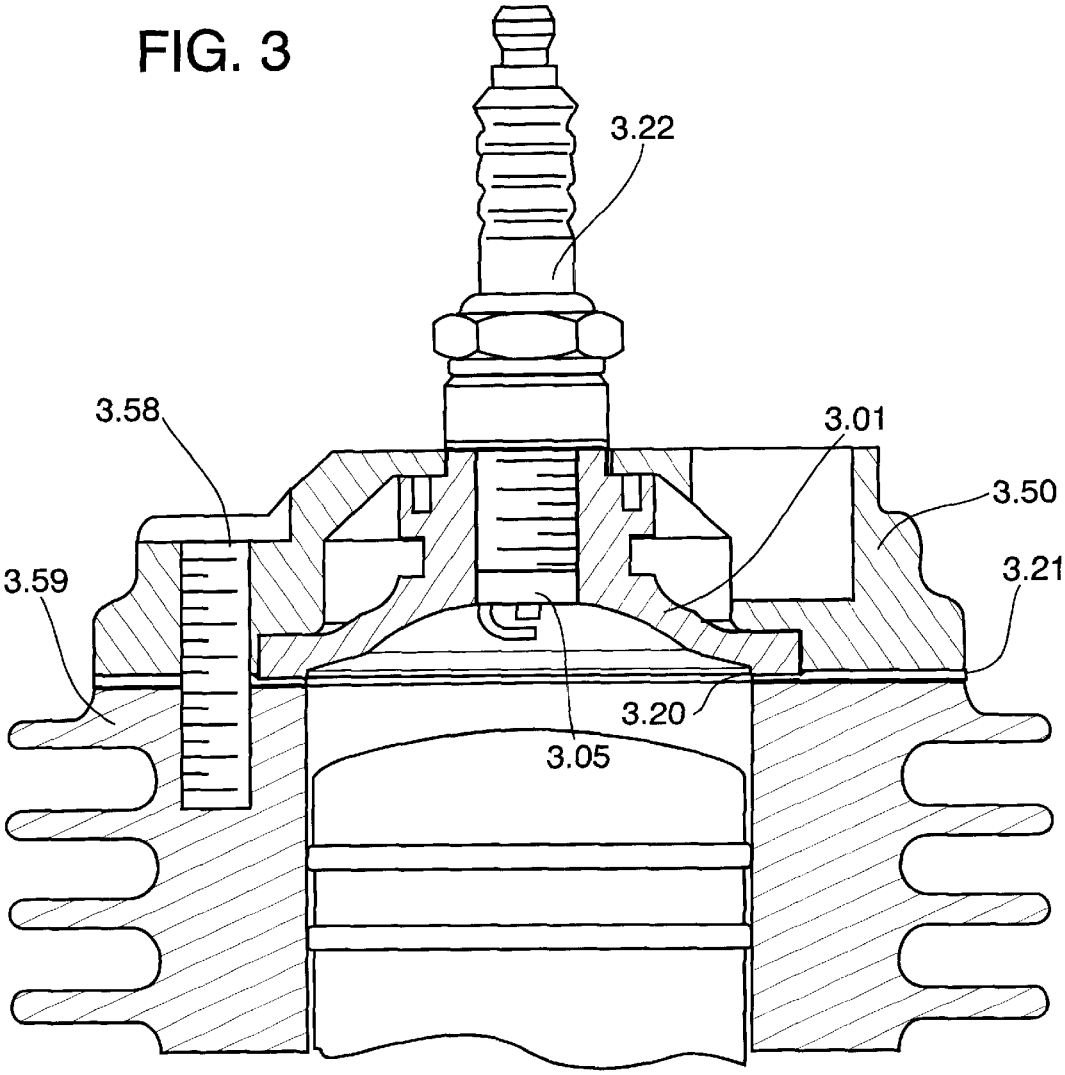
FIG. 3 is a cross-sectional view of the instant invention when practiced and inserted within a two cycle internal combustion engine bolted to a two cycle internal combustion engine block.

FIG. 3 illustrates a cross-sectional view of the instant invention when practiced in its preferred embodiment and inserted within a two cycle internal combustion engine cylinder head 3.50 which is bolted to the engine's cylinder block 3.59. Also illustrated in FIG. 3 is a first step of the insert 3.20 which has been machined to allow for a 5–8 thousandth of an inch projection beyond the depth of the receiving bore of the cylinder head 3.50 to permit the cylinder head 3.50 to crush said first step 3.20 of the insert between the cylinder head 3.50 and cylinder head gasket 3.21, when cylinder head stud bolts 3.58 are properly torqued to prevent rotation of the insert 3.01 during installation and removal of a spark plug 3.22.

The procedure for producing the combustion chamber insert is to first machine the insert from solid aluminum billet, the material could also be bronze, ceramic, or other material for certain fuels, leaded or unleaded, starting with the diameter of the bore of the cylinder for the engine and following the contour of the engines piston or dome shape. The thickness of the first step on the bottom of the insert must be 5 to 8 thousandths of inch thicker than the depth of the receiving bore in the cylinder head cover to permit the cylinder head cover to crush this extension of the insert past the cover surface between the cover and the cylinder head gasket when the cylinder head stud bolts are properly torqued to prevent rotation of the insert during installation and removal of the spark plug. This amount of extension of the insert from the bottom of the cover has been found to work very satisfactorily in actual application.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is clear that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

While this invention has been described to illustrative embodiments, this description is not to be construed in a limiting sense. Various modifications and combinations of the illustrative embodiments as well as other embodiments will be apparent to those skilled in the art upon referencing this disclosure. It is therefore intended that this disclosure encompass any such modifications or embodiments.

What is claimed is:

1. A method of producing a replaceable combustion chamber insert for two cycle engines comprising the steps of:

(a) determining location and measurement dimensions of outside shape, water passages, water connection, and bolt hole pattern of a two cycle cylinder head within which said insert is to be positioned;

(b) machining said insert inner diameters, o-ring groove, dome, and outer shape to correspondingly complement said determined location and measurement dimensions, said cylinder head's bore diameter and causing said insert to extend between 5 to 8 thousandths of inch below the bottommost surface of said cylinder head so as to create a compressible surface; and (c) machining a spark plug threaded hole within said insert.

2. An improved two cycle combustion chamber insert in accordance with the process of claim 1.

* * * * *